US009035798B2

(12) United States Patent
Bessler et al.

(10) Patent No.: US 9,035,798 B2
(45) Date of Patent: May 19, 2015

(54) METHOD FOR DETERMINING TRAFFIC FLOW DATA IN A ROAD NETWORK

(71) Applicant: Kapsch TrafficCom AG, Vienna (AT)

(72) Inventors: Sandford Bessler, Vienna (AT); Thomas Paulin, Vienna (AT); Marko Jandrisits, Vienna (AT)

(73) Assignee: Kapsch TrafficCom AG, Vienna (AT)

( * ) Notice: Subject to any disclaimer, the term of this patent is extended or adjusted under 35 U.S.C. 154(b) by 359 days.

(21) Appl. No.: 13/726,276

(22) Filed: Dec. 24, 2012

(65) Prior Publication Data

US 2013/0162445 A1 Jun. 27, 2013

(30) Foreign Application Priority Data

Dec. 27, 2011 (EP) ..... 11195820

(51) Int. Cl.

| | |
|---|---|
| ***G08C 17/02*** | (2006.01) |
| ***G08G 1/01*** | (2006.01) |
| ***G07C 5/08*** | (2006.01) |

(52) U.S. Cl.

CPC ..... *G08C 17/02* (2013.01); *G08G 1/0112* (2013.01); *G07C 5/08* (2013.01); *G08G 1/0133* (2013.01); *G08G 1/0141* (2013.01)

(58) Field of Classification Search

None

See application file for complete search history.

(56) References Cited

U.S. PATENT DOCUMENTS

| | | | | |
|---|---|---|---|---|
| 4,350,970 | A * | 9/1982 | von Tomkewitsch | 340/989 |
| 5,289,183 | A | 2/1994 | Hassett et al. | |
| 5,812,069 | A * | 9/1998 | Albrecht et al. | 340/905 |
| 6,282,486 | B1 * | 8/2001 | Bates et al. | 701/117 |
| 7,831,380 | B2 * | 11/2010 | Chapman et al. | 701/118 |
| 2002/0082766 | A1 * | 6/2002 | Ormson | 701/117 |
| 2006/0055565 | A1 * | 3/2006 | Kawamata et al. | 340/995.13 |
| 2011/0320112 | A1 * | 12/2011 | Anderson | 701/119 |

FOREIGN PATENT DOCUMENTS

| | | |
|---|---|---|
| DE | 10252768 | 6/2004 |
| EP | 0029201 | 5/1981 |
| WO | 02075664 | 9/2002 |

OTHER PUBLICATIONS

Extended European Search Report dated May 23, 2012 from the European Patent Office.

* cited by examiner

*Primary Examiner* — Benjamin C Lee
*Assistant Examiner* — Rajsheed Black-Childress
(74) *Attorney, Agent, or Firm* — Fiala & Weaver P.L.L.C.

(57) ABSTRACT

Determining traffic flow data in a road network comprising passing a first radio beacon and receiving a request message that at least includes a start location and a stop location; determining if an on-board unit position is within a predetermined range of the start location, and responsively starting a recording of measurement data; determining if the on-board unit position is within a predetermined range of the stop location, and responsively stopping the recording of the measurement data; and transmitting the recorded measurement data to a next radio beacon that is passed by the on-board unit.

14 Claims, 3 Drawing Sheets

METHOD FOR DETERMINING TRAFFIC FLOW DATA IN A ROAD NETWORK

FIELD OF THE INVENTION

Described herein are systems and methods for determining traffic flow data in a road network.

BACKGROUND OF THE INVENTION

The term "traffic flow data" as used in this specification means all types of sensor and measurement data from and relating to vehicles of moving and stationary traffic that can be collected on the level of granularity of individual vehicles and can provide an overview of the traffic situation, the "traffic flow" in a road network or a section thereof in the form of, e.g., a statistical analysis over several vehicles.

Modern vehicles have a variety of sensors for the generation of measurement data, such as speed, acceleration and deceleration, data from the Antilock Braking System (ABS) and Electronic Stability Program (ESP) systems of the vehicle, status of the lighting and heating systems, environmental and weather data such as daylight, outside temperature, air humidity, visibility (fog), data from camera and radar systems of the vehicle for detecting the surrounding traffic and hazards, etc. The multitude of measurement data from the vehicle is further increased by measurement data of electronic accessory devices ("on-board units", OBUs), e.g. satellite navigation receivers and/or transceivers for radio communication with roadside radio beacons ("Roadside Units", RSUs). The term "radio beacon" as used herein refers to devices generally used to transmit and receive wireless radio signals, including wireless radio beacon signals. On-board units can receive measurement data of the vehicle as well as, by means of its own sensors, acquire measurement data relating to the vehicle and/or its environment, e.g., positions and speeds measured by means of satellite navigation from radio communications with radio beacons or mobile networks, environmental data from its own weather sensors, etc.

However, determining meaningful traffic flow data is a non-trivial problem in practice even with vehicles equipped as such. A transmission of the measurement data of all vehicles to a central analysis unit is not realistic due to the large volume of data and the limited transmission capacities of currently available wireless channels, e.g., of mobile radio systems. Moreover, the measurement data generated by the individual vehicles are highly redundant in dense traffic and of little use with "fair weather conditions" (low traffic, good weather, no incidents or accidents). Therefore, present systems for collecting traffic flow data only use a limited number of specially equipped vehicles, e.g. taxis, which go with the flow of the traffic to provide a representative picture of the traffic situation or the environmental situation. However, this firstly requires a special fleet of vehicles, and secondly requires a permanent data link from these vehicles to the analysis center, normally a data link to a wireless network, which is expensive and requires many resources.

The technical report ETSI TR 102 898 "Machine to Machine Communications (M2M); Use cases of Automotive Applications in M2M capable networks", V 0.4.0, September 2010, Chapter 5.2.3, describes scenarios for traffic information services which distribute information from a central unit via wireless networks to OBUs, which in turn send traffic flow data to the central unit in the case of specific events. This design can be attributed to the aforementioned non-specific data collection solutions having the disadvantage of an uncontrollable high amount of data without any possibility of a location-specific access to the data-generating vehicles in the collection process.

SUMMARY

In contrast to the systems described in the ETSI technical report, some embodiments described herein create a method for collecting traffic flow data that overcomes the said disadvantages.

This is achieved according to some embodiments by using a method for determining traffic flow data in a road network having road segments of which at least some are equipped with radio beacons for DSRC (Dedicated Short Range Communications) with vehicle-mounted on-board units, which are configured to determine their position and record measurement data of their vehicle or their environment, comprising the following steps carried out by an on-board unit:

a) passing a first radio beacon and receiving a request message, which at least includes a start location and a stop location, from the first radio beacon via a first DSRC radio communication;

b) determining if a position of the on-board unit is within a predetermined range of the start location, and starting the recording of the measurement data;

c) determining if the position of the on-board unit is within a predetermined range of the stop location, and stopping the recording of the measurement data; and d) transmitting the recorded measurement data to the next radio beacon that is passed by the on-board unit along its way via a second DSRC radio communication.

The method according to some embodiments uses the location-based infrastructure of a network of Roadside Units as is currently already used for example in road tolling systems, traffic telematics and/or vehicle communication systems and is based on dedicated short range communications (DSRC) between vehicle-mounted OBUs and RSUs. The limited range of such DSRC radio communications permits a location-specific feed of requests for data collection into a subset of the road users of the road network, namely all vehicles moving between a start location and a stop location and serving as data sources for the determination of the traffic flow data. In this connection, the collection area is not bound to the locations of the particular RSUs, but will be defined by the self-localization of the OBUs. As a result, comprehensive, nearly continuous traffic flow data from a specific area of a wide road network can be acquired with the lowest possible storage requirements and the lowest possible load on the available communication channels, i.e. limited to DSRC radio communications between OBUs and RSUs around the collection area.

According to a further aspect of some embodiments, a method for determining traffic flow data that uses a multitude of on-board units, each of which carries out the aforementioned steps a) to d), also includes the following steps:

determining a first group of radio beacons as those radio beacons that are the last in substantially all possible access routes to the start location formed by the road segments of the road network;

providing the request message to the radio beacons of the first group; and transmitting the request message from each radio beacon of the first group for reception by all on-board units or by at least a subset of the on-board units while passing such radio beacon according to step a).

Where a subset of the passing on-board units is used, the subset is appropriately defined as a representative selection, e.g. every second, third, tenth, hundredth, etc., of the passing on-board units.

The methods described herein can be triggered locally within a radio beacon that compiles and distributes the request message to the radio beacons of the first group. However, in some embodiments the request message is compiled in a central unit interconnected with the radio beacons and is sent by the central unit to the radio beacons of the first group. This allows a traffic control at all times to get a detailed view of the traffic situation in a section of the road network.

In further embodiments the method comprises the following additional steps:

selecting a radio beacon as a data-collecting radio beacon; and forwarding the measurement data emitted by on-board units in their step d) from the particular receiving radio beacon to the data-collecting radio beacon.

In order to keep the data traffic between the radio beacons to a minimum, the data-collecting radio beacon is set up as near as possible to the collection area. In some embodiments this is done by applying these additional steps:

determining a second group of radio beacons as those radio beacons that are the first in substantially all possible exit routes from the stop location formed by the road segments of the road network; and selecting the data-collecting radio beacon from the second group.

In embodiments that utilize a central data analysis technique, the measurement data is sent by the data-collecting radio beacon to the central unit for analysis.

In order to further reduce the data traffic between the data-collecting radio beacon and the central unit, some embodiments provide for the measurement data to be pre-analyzed and compressed by the data-collecting radio beacon before being sent to the central unit for analysis.

In any of the embodiments described herein, the request message may also include a specification of a type of measurement data to be recorded, while the on-board unit only records (or reports) measurement data of such type, and/or the request message can also include a specification of a period of validity, while the on-board unit only records (or reports) measurement data within such period of validity. This permits the system to further specify the requests for data collection, which allows an even more exact view of the traffic situation. The radio beacon can also interrogate an on-board unit before sending the request message to retrieve the type of measurement data collected by the on-board unit and to adapt the request message accordingly.

BRIEF DESCRIPTION OF THE FIGURES

Further features and advantages of the invention follow from the following detailed description of various embodiments that make reference to the accompanying drawings in which.

DETAILED DESCRIPTION

Figure 1:
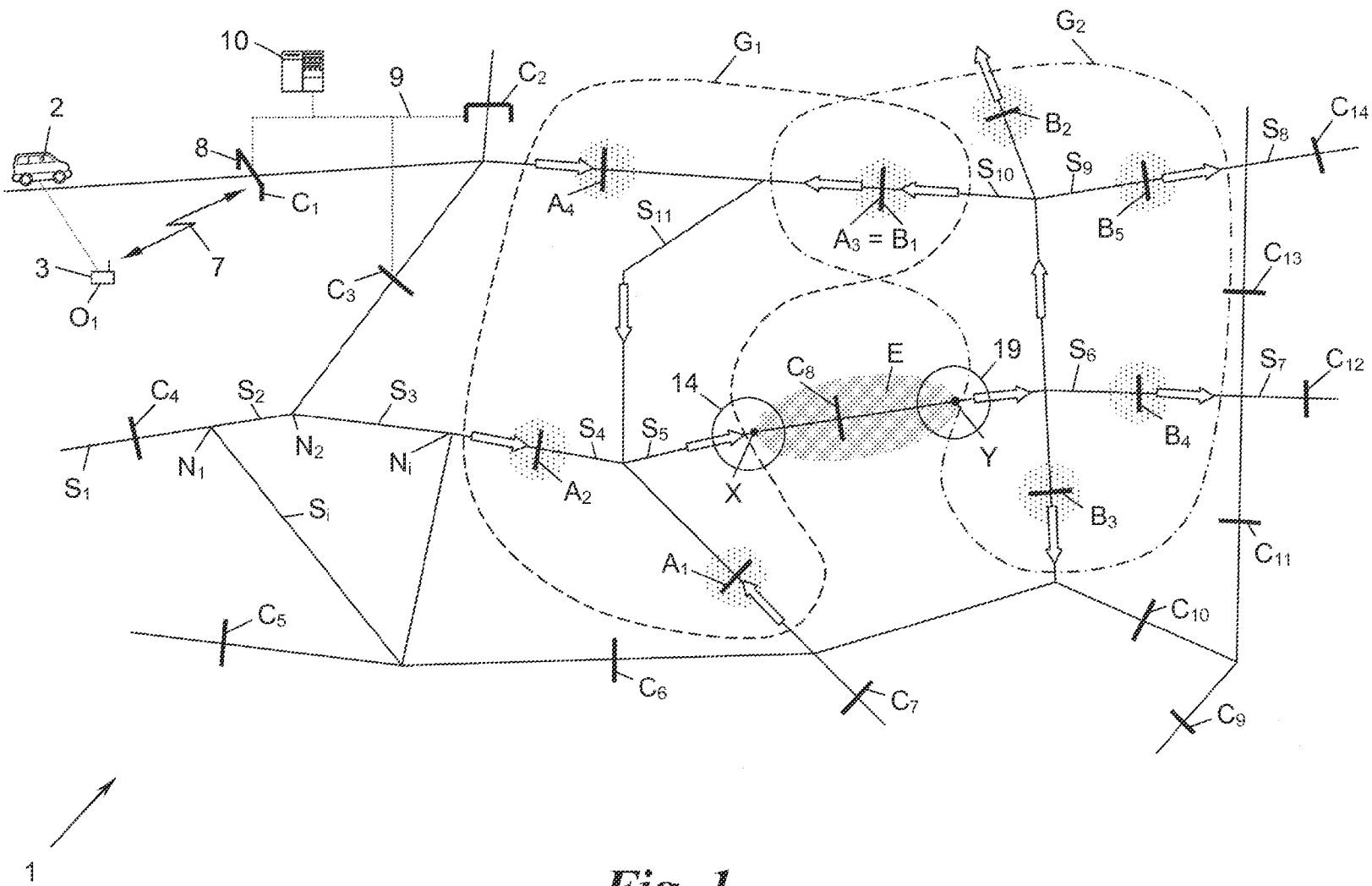
FIG. 1 shows a schematic depiction of a road network with components used by the method described herein.

In FIG. 1, a schematic depiction of a road network 1 is depicted, comprising a multitude of road segments $S_1$, $S_2$, $S_3$, . . . , generally $S_i$, between which connection points or nodes $N_1$, $N_2$, $N_3$, . . . , generally $N_i$, are located. Accordingly, the road network 1 can be modeled or depicted by a corresponding network graph, as is known to those of skill in the art. It is understood that individual road segments Si can be defined for different lanes and/or directions of travel in the road network 1.

In the road network 1, there are a multitude of moving vehicles 2 (of which only one example is shown) each of which is equipped with an on-board unit (OBU) 3, here identified by the designations $O_1$, $O_2$, $O_3$, . . . , generally $O_i$. In addition to a micro-processor 4 and a tangible storage medium 5, each OBU 3 has a short-range transceiver 6 (FIG. 2) via which the OBU can handle dedicated short range communications (DSRC) 7 with radio beacons 8 of the road toll systems 1.

The radio beacons 8 are locally distributed across the entire road network 1 and are designated in this example as $A_1$, $A_2$, $A_3$, . . . , generally $A_i$, $B_1$, $B_2$, $B_3$, . . . , generally $B_i$, and $C_1$, $C_2$, $C_3$, . . . , generally $C_i$. The radio beacons 8 are each installed as Road Side Units (RSUs) at a road segment $S_i$, whereby also several radio beacons 8 can be installed at a road segment $S_i$ or one radio beacon 8 can cover several road segments $S_i$.

The radio beacons 8 are interconnected e.g. via a wired data network 9 and can also be interconnected via this data network with a central unit 10 of the road network 1, for example a traffic control or toll charger (TC).

Due to the short range of the radio communications 7 between OBUs 3 and radio beacons 8, the vehicles 2 passing a radio beacon 8 can be localized on the location or radio coverage range of this radio beacon 8. The radio beacons 8 are, for example, part of a road toll system in which they localize the movements of the vehicles 2 by means of the radio communication 7, to charge the vehicles 2 for passing toll roads accordingly. Further applications of the radio beacons 8 may include, for example, the distribution of traffic information or "infotainment" to passing vehicles 2 and/or the reception of data of the passing vehicles 2.

The radio communications 7, i.e. notably the transceivers 6 of the OBUs 3 and the radio beacons 8, may work according to any of the many short range wireless standards as is known to those of skill in the art, such as the DSRC standards ITS-G5, IEEE 802.11p, WAVE (wireless access in a vehicle environment), WLAN (wireless local area network), RFID (radio frequency identification), Bluetooth®, etc. The radio range of the radio communication 7 (and the radio coverage range of the radio beacons 8) usually is some 10 to some 100 meters, but specifically with WLAN, WAVE and IEEE 802.11p can be up to some number of kilometers, and usually is not larger than the extension of the road segment $S_i$ to which the radio beacon 8 is assigned, and usually does not overlap with the radio coverage range of an adjacent radio beacon 8. It is preferably as limited as possible so as to achieve a localization of the passing vehicles 2 as precisely as possible.

The described infrastructure of the road network 1 is now used to collect traffic flow data from a narrowly limited area E of the road network 1 in the following description.

Figure 3:
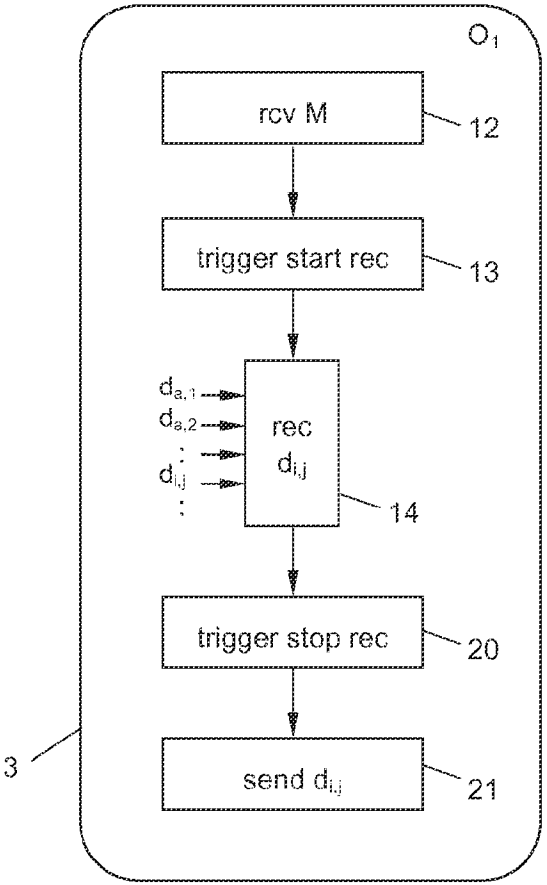
FIG. 3 shows a flow chart of one of the processes running in the on-board unit of FIG. 2.
Figure 2:
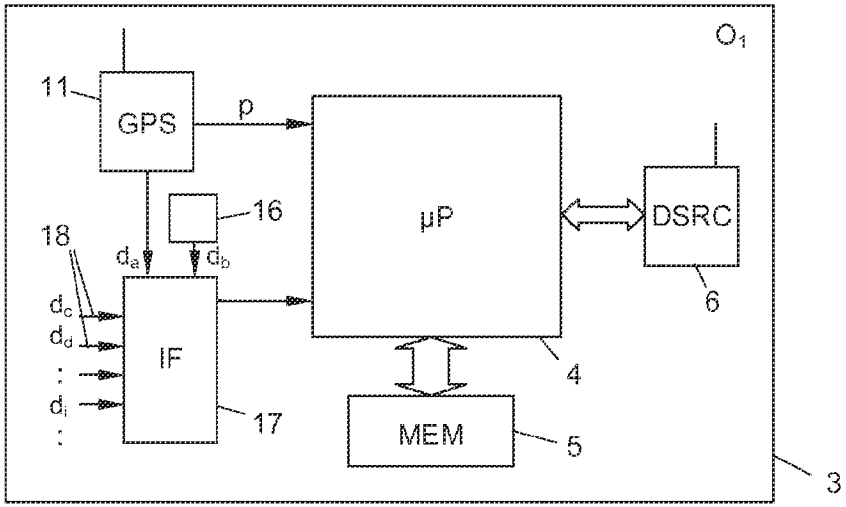
FIG. 2 shows a block diagram of one of the on-board units of the road network of FIG. 1.

To this end, the systems and methods described herein may use specifically equipped OBUs, which are explained in detail with respect to FIG. 2 and FIG. 3. The OBUs 3 and $O_i$ as contemplated herein have the capability for both the radio communication 7 and for autonomously locating their own position p in the road network 1, namely by means of a positioning device 11. The positioning device 11 can determine the position p of the OBU 3 for example by an optical detection of specific landmarks in camera images of its environment, by means of radio triangulation in terrestrial radio networks, by means of cell detection in mobile networks, etc. The positioning device 11 in some embodiments is a satellite navigation receiver for a global navigation satellite system (GNSS), like GPS, GLONASS, GALILEO, etc.

Using the positioning device 11 every OBU 3 is capable of autonomously detecting when the collection area E is entered and is exited. For this purpose, the collection area E is defined by its start location X on the associated road segment $S_i$ and its stop location Y on this (or another) road segment $S_i$, i.e. in the example illustrated it spreads over the road segment $S_5$ between the start location X and the stop location Y. In this respect it is irrelevant whether a radio beacon $C_8$ is located in the collection area E or not.

Figure 5:
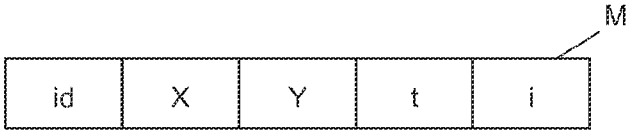
FIG. 5 shows the structure of a request message for data collection in the processes of FIG. 3 and FIG. 4.

A location-specific distribution process—to be further outline below—which accesses the network of radio beacons 8 now provides every OBU 3 with a request for data collection from a radio beacon 8 in the form of a request message M (FIG. 5), which in some embodiments includes the start location X and the stop location Y. FIG. 3 shows the procedure triggered by such message in an OBU 3 in detail.

According to FIG. 3, in a first step 12, when passing a first radio beacon 8, the request message M is received through a (first) radio communication 7. The OBU 3 stores the start location X and the stop location Y from the request message M and it then determines and compares its own position p with the start location X in step 13. The determination may be ongoing in that periodic or sufficiently frequent assessments of its current position may be made. Once the position p gets within a (preset, or predetermined) close range 14 (FIG. 1) around the start location X, the data collection for the collection area E is started, i.e. a recording 14 of measurement data d is started.

The measurement data d recorded in the data collection process 14 may be of any of the abovementioned type i, for example position, speed or motion vector data $d_a$ from the positioning device 11, temperature and weather and environmental pollution data $d_b$ from internal weather and pollutant sensors 16 of the OBU 3, engine or exhaust data $d_c$ or ABS or ESP data $d_d$ of the vehicle 2, which are received from vehicle 2 via an interface module 17 having wireless or wired interfaces 18, etc.

Thus, the recording process 14 records all measurement data $d_{i,j}$ accumulated for one (or more) selected sensor and measurement data types i and stores such data in the storage 5 of the OBU 3 on an ongoing basis, i.e. continuously or at discrete times j. The selected measurement data type(s) i may be for example predefined or only forwarded in a request message M of the OBU 3.

If the request message M also includes a period of validity t, the individual OBUs 3 or $O_i$ may also check and ensure in the recording process 14 that measurement data $d_{i,j}$ is only recorded within the period of validity t.

The collection process 14 is terminated once the positioning device 11 detects the entry into a (preset or predetermined) close range 19 of the stop location Y (step 20). The close ranges 14, 19 around the start location X and the stop location Y serve as a tolerance for measuring inaccuracies of the positioning device 11 and are minimized according to the accuracy of the positioning device 11 so as to define the collection area E as accurately as possible.

Afterwards, the measurement data recorded in step 14 is sent in a step 21 to the next best radio beacon 8, which the OBU 3 meets on its way, via a (second) radio communication 7.

Should for any reason the stop location Y not be detected within a preset distance from the start location X or within a reasonable time, e.g. within the period of validity t, the request message M and the recorded measurement data $d_{i,j}$ may be deleted in the OBU in certain embodiments.

A large number of OBUs 3, which, when passing the collection area E, execute the procedure shown in FIG. 3, may determine traffic flow data related to the collection area E, thus creating a detailed picture of the traffic situation in the collection area E. The execution of the data collection request necessary in step 12 and the data return in step 21 is now explained in detail with reference to FIG. 4 for the entire road network of FIG. 1.

Figure 4:
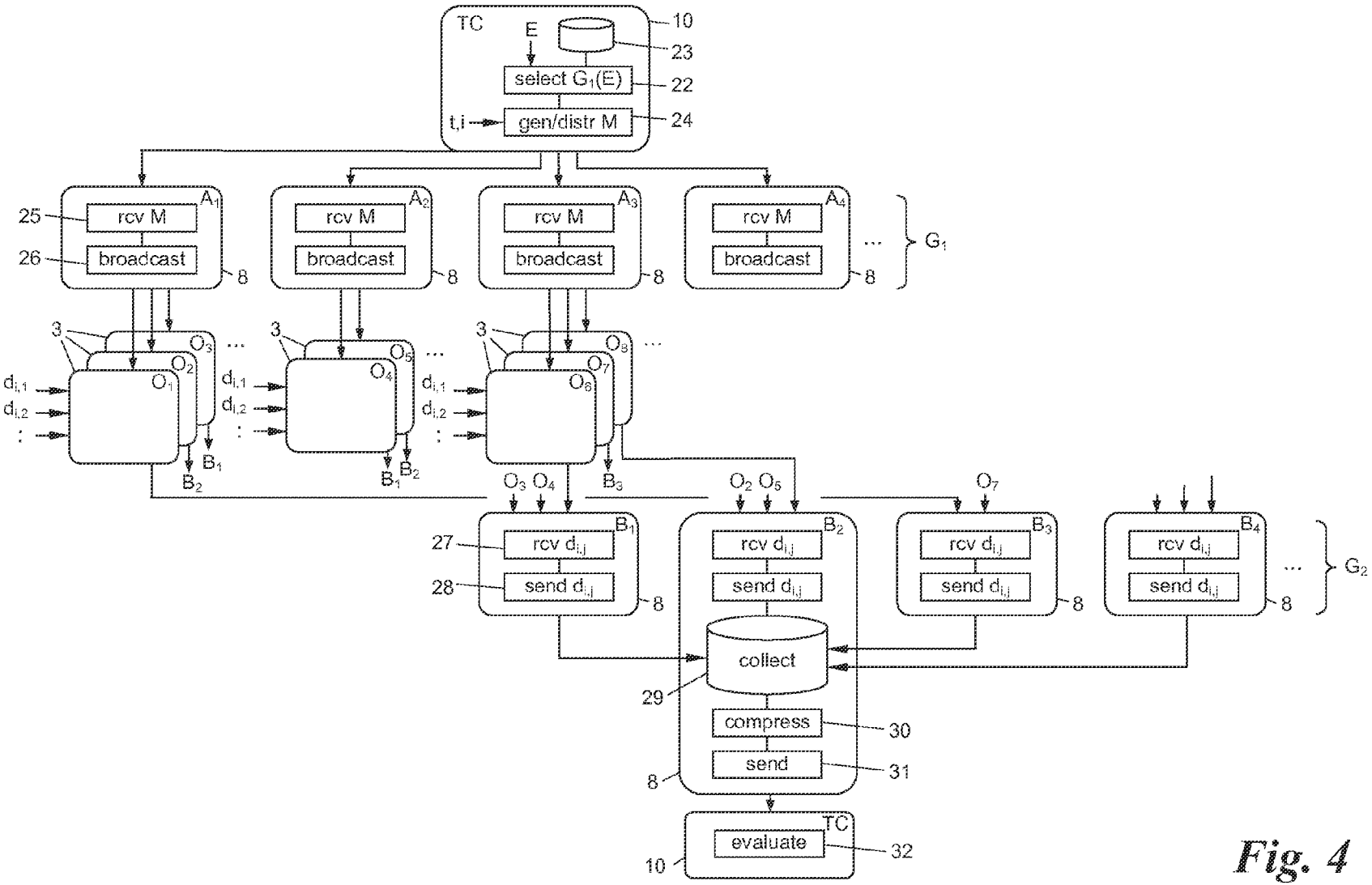
FIG. 4 shows a flow chart of one of the processes running in the road network of FIG. 1.

FIG. 4 shows the principle of the location-specific feed of data collection requests M into the road network 1 by means of the network of distributed radio beacons 8. The procedure starts in the central unit 10 of the network 9 of radio beacons 8, where the central unit 10 could also be implemented by, or integrated within, one of the radio beacons 8.

Given the relevant collection area E, a first group $G_1$ of (first) radio beacons 8, depicted in FIG. 4 as the radio beacons $A_1$, $A_2$, $A_3$ and $A_4$, is selected in a first step 22 which serves to feed in the request messages M into the passing OBUs 3. The first group $G_1$ is composed of those radio beacons 8 that are the last in substantially all possible access routes via which the start location X of the collection area E can be reached ("substantially all possible access routes" includes the major access routes. In the example of FIG. 1, the radio beacons $C_4$ and $A_2$ are in the access route $S_1$-$S_2$-$S_3$-$S_4$-$S_5$ to the start location X, with the radio beacon $A_2$ being the last located in the access route. In the alternatively possible access route $S_8$-$S_9$-$S_{10}$-$S_{11}$-$S_5$ to the start location X, there are for example located the radio beacons $C_{14}$, $B_5$ and $A_3$=$B_1$, of which radio beacon $A_3$=$B_1$ is the last. Accordingly, the said radio beacons $A_1$, $A_2$, $A_3$=$B_1$ and $A_4$ follow as the first group $G_1$ over all possible access routes to the start location X.

The selection of the radio beacons 8 for the group $G_1$ in step 22 can for example be made by means of known algorithms of the graph theory from a network graph model of the road network 1, which is e.g. deposited in a database 23 of the central unit 10.

In a subsequent step 24, the request message M is compiled and may also include, for example, a period of validity t, e.g. in the form of an expiry time. The request message M is then distributed in step 24 by the central unit 10 via the data network 9 to all radio beacons 8 of the first group $G_1$, which receive this message in a receive step 25.

The radio beacons 8 and $A_1$, $A_2$, $A_3$, $A_4$ of the first group $G_1$ subsequently send the request message M to every OBU 3 passing them in a step 26; every OBU 3 receives the request message M in step 12 (FIG. 3).

In some alternative embodiments, the radio beacons 8 of the first group $G_1$ can send the request message M not to all, but only to a subset of the passing OBUs 3, e.g. to every second, third, tenth, hundredth, etc., passing OBU 3.

FIG. 4 shows an exemplary scenario, in which the radio beacon $A_1$ is consecutively passed by three OBUs $O_1$, $O_2$, $O_3$, while the radio beacon $A_2$ is consecutively passed by two OBUs $O_4$, $O_5$; and the radio beacon $A_3$ is consecutively passed by three OBUs $O_6$, $O_7$, $O_8$. It is understood that the send and receive steps 26, 12 each are triggered when an OBU 3 passes a radio beacon 8, i.e. at different times. As long as a radio beacon 8 of the first group $G_1$ does not receive an instruction to the contrary from the central unit 10, it continues with the transmission 26 of request message M to all passing OBUs 3. Such an instruction to the contrary, i.e. a request to the radio beacons 8 of the first group $G_1$ to stop the send step 26, can for example be issued by means of a deactivation message sent by the central unit 10 to the radio beacons 8 of the first group $G_1$ regarding the previously sent request message M, for which purpose the request messages M can also be referenced through unique identifiers id.

Every OBU 3 (here $O_1$ to $O_8$) which has received a request message M, is carrying out the data collection process as already explained by means of FIG. 3, i.e. every OBU 3 is recording sensor data $d_{i,j}$ between the start location X and the stop location Y and delivers the recorded sensor data $d_{i,j}$ to the next radio beacon 8 on its route (step 21). All possible next radio beacons 8 that in this way can receive measurement data $d_{i,j}$ from an OBU 3 form a second group $G_2$ (FIG. 1).

The second group $G_2$ is composed of all those radio beacons 8 that are the first in the exit routes (leaving routes) from the stop location Y. For instance, in the exit route $S_5$-$S_6$-$S_7$ from the stop location Y, the radio beacons $B_4$ and $C_{12}$ are present with the radio beacon $B_4$ being the first; therefore, the radio beacon $B_4$ is the radio beacon to which the OBU 3 will transmit its recorded measurement data $d_{i,j}$ in the step 21. Thus, the radio beacons $B_1$=$A_3$, $B_2$, $B_3$, $B_4$, $B_5$ of the second group $G_2$ as depicted in FIG. 1 follow from all possible exit routes from the stop location Y. FIG. 4 shows the receive step 27 in the radio beacons 8 (here $B_1$, $B_2$, $B_3$, $B_4$, $B_5$) of the second group $G_2$ associated with the send step 21.

For analysis of the collected measurement data $d_{i,j}$ of all OBUs $O_i$, the radio beacons 8 of the second group $G_2$ are now sending all measurement data $d_{i,j}(O_i)$ in a send step 28 either directly to the central unit 10 or—as in the depicted embodiment—to a selected "data-collecting" radio beacon 8 of the second group $G_2$, here radio beacon $B_2$, i.e. more precisely to a data collection process ("container") 29 in the data-collecting radio beacon $B_2$, which can carry out a pre-analysis and data compression of the collected measurement data $d_{i,j}(O_i)$, e.g. a statistical analysis, in embodiments that perform a pre-analysis step 30. The collected and in some embodiments, pre-analyzed, measurement data $d_{i,j}(O_i)$ is subsequently sent to the central unit 10 in a step 31 for final analysis 32.

The analysis in step 32 can for example determine a traffic density and/or mean traffic flow speed in the collection area E, generate traffic jam forecasts, also on the basis of weather measurement data, deceleration measurement data, etc., and generally on the basis of all aforementioned types i of the measurement data $d_{i,j}$ and its courses recorded over the time j.

The invention is not limited to the embodiments as presented, but comprises all versions and modifications covered by the appended claims.

In general, it should be understood that the circuits described herein may be implemented in hardware using integrated circuit development technologies, or yet via some other methods, or the combination of hardware and software objects that could be ordered, parameterized, and connected in a software environment to implement different functions described herein. For example, the systems may be implemented using a general purpose or dedicated processor device running a software application or program code stored in volatile or non-volatile memory devices. Devices so programmed may be used to perform the methods described herein. Also, the hardware objects could communicate using electrical signals, with states of the signals representing different data.

It should be further understood that these and other arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

We claim:

1. A method for determining traffic flow data in a road network with road segments of which at least some are equipped with radio beacons for DSRC radio communications with vehicle-mounted on-board units, which are configured to determine their position and record measurement data of their vehicle or their environment, comprising the following steps carried out by an on-board unit:

a) passing a first radio beacon and receiving a request message, which at least includes a start location and a stop location, from the first radio beacon via a first DSRC radio communication;

b) determining if a position of the on-board unit is within a predetermined range of the start location, and starting recording of measurement data;

c) determining if the position of the on-board unit is within a predetermined range of the stop location, and stopping the recording of the measurement data; and d) transmitting the recorded measurement data to a next radio beacon that is passed by the on-board unit along its way via a second DSRC radio communication.

2. The method according to claim 1 using a plurality of on-board units each of which carries out the steps a) to d), further comprising:

determining a first group of radio beacons comprising those radio beacons that are the last in substantially all possible access routes to the start location formed by road segments of the road network;

providing the request message to the radio beacons of the first group; and transmitting the request message from each radio beacon of the first group to at least a subset of the on-board units passing such radio beacon according to step a).

3. The method according to claim 2, wherein the request message is compiled in a central unit interconnected with the radio beacons and is sent by the central unit to the radio beacons of the first group.

4. The method according to claim 2, further comprising:

selecting a radio beacon as a data-collecting radio beacon; and forwarding the measurement data transmitted by on-board units in its respective step d) from the particular receiving radio beacon to the data-collecting radio beacon.

5. The method according to claim 4, further comprising:

determining those radio beacons that are the first in substantially all possible exit routes from the stop location formed by the road segments of the road network, as a second group of radio beacons; and selecting the data-collecting radio beacon from the second group.

6. The method according to claim 4 wherein the measurement data is sent by the data-collecting radio beacon to a central unit for analysis.

7. The method according to claim 6, wherein the measurement data is pre-analyzed and compressed by the data-collecting radio beacon, before the data is sent to the central unit for analysis.

8. The method according to claim 1 wherein the request message also includes a specification of a type of measurement data to be recorded, with the on-board unit only recording measurement data of this type.

9. The method according to claim 8wherein the radio beacon interrogates an on-board unit before sending the request message to retrieve the type of measurement data collected by that on-board unit, whereupon the request message is adjusted accordingly.

10. The method according to claim 1 wherein the request message also includes a specification of a period of validity, with the on-board unit only recording measurement data within such period of validity.

11. The method according to claim 1 wherein the position of the on-board unit is determined by means of satellite navigation.

12. The method according to claim 1 wherein the measurement data comprise speed and/or deceleration data of the on-board unit or its vehicle.

13. The method according to claim 1 wherein the measurement data comprise weather data from an environment of the on-board unit or its vehicle.

14. The method according to claim 1 wherein the measurement data comprise pollutant emission data from an environment of the on-board unit or its vehicle.

* * * * *